US007188810B1

(12) United States Patent
Lasky

(10) Patent No.: US 7,188,810 B1
(45) Date of Patent: Mar. 13, 2007

(54) BABY BOTTLE SUPPORT ASSEMBLY

(75) Inventor: Sonja M. Lasky, Norfolk, VA (US)

(73) Assignee: Sonja Mila Lasky, Carrollton, VA (US)

( * ) Notice: Subject to any disclaimer, the term of this patent is extended or adjusted under 35 U.S.C. 154(b) by 79 days.

(21) Appl. No.: 11/204,364

(22) Filed: Aug. 16, 2005

(51) Int. Cl.
*A47D 15/00* (2006.01)

(52) U.S. Cl. ..... 248/103; 248/106

(58) Field of Classification Search ..... 248/102, 248/103, 104, 105, 106, 107
See application file for complete search history.

(56) References Cited

U.S. PATENT DOCUMENTS

| | | | | |
|---|---|---|---|---|
| 1,826,810 | A * | 10/1931 | Buichi | 248/102 |
| 1,863,163 | A * | 6/1932 | Malti et al. | 248/102 |
| 2,211,227 | A | 8/1940 | Feindel | |
| 2,459,514 | A | 1/1949 | Flickinger | |
| 3,000,601 | A | 9/1961 | Pedro | |
| 3,120,368 | A * | 2/1964 | Crisp | 248/103 |
| 3,635,431 | A * | 1/1972 | Mariner | 248/104 |
| 4,014,505 | A * | 3/1977 | Dowd | 248/105 |
| 4,315,654 | A * | 2/1982 | Crook | 297/188.2 |
| 5,092,549 | A * | 3/1992 | Beech | 248/103 |
| D326,524 | S | 5/1992 | Lawal et al. | |
| 5,192,041 | A | 3/1993 | Bryant | |
| 5,727,842 | A * | 3/1998 | O'Neil | 297/188.06 |
| 6,523,793 | B1 | 2/2003 | Higgins | |
| 6,640,985 | B1 * | 11/2003 | Cheng | 211/118 |

* cited by examiner

*Primary Examiner*—Ramon O Ramirez

(57) ABSTRACT

An assembly includes an adjustable strap that has slidable first and second sections. The first section has opposed ends, a groove formed in a top surface, extending downwardly along a partial length thereof, originating medially thereof and terminating at one opposed end. The second section has opposed ends and a finger formed with one end that is slidable within the groove. The first and second sections overlap when the finger engages the groove. A retaining member is disposed about the first and second sections so that the finger member is maintained in the groove. A ring has a handle that is engageable with the strap. The strap and the ring are formed from rigid material for supporting a bottle's weight. A mechanism is included for fastening the strap to a support surface. Pins define a fulcrum axis about which the first and the second sections are pivoted.

18 Claims, 4 Drawing Sheets

BABY BOTTLE SUPPORT ASSEMBLY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to support assemblies and, more particularly, to a baby bottle support assembly for assisting a caregiver in feeding a baby.

2. Prior Art

Infants typically need to be fed numerous times a day, especially during the first few months of life. Since infants are not able to feed themselves, it is necessary for the caregiver to sit with the infant and feed him or her with a bottle. This requires the caregiver to stop whatever he or she is doing at that moment in order to tend to the infant.

Thus, there exists a need for an infant feeding device which would enable hands free feeding of the infant in a safe and comfortable setting. Such a device should support and provide a bottle to the infant. Many infant feeding devices are available that allow a caregiver to feed an infant a bottle without having to hold the infant. Most of these devices comprise a bottle holder that attach to existing infant seats or the like. While such units may be suitable for the particular purpose employed, or for general use, they still have many shortcomings.

One disadvantage of such feeding devices is the limited width thereof that does not enable a single device to be employed on infant seats, strollers and bouncers. Thus, the caregiver is limited in their use of the feeding device and may still be required to manually feed the infant in certain situations. A further disadvantage of certain prior art examples is the bulky design of the feeding device, which makes the production thereof unfeasible and limits the movements of an infant while feeding with the device.

Accordingly, a need remains for a baby bottle support assembly in order to overcome the above-noted shortcomings. The present invention satisfies such a need by providing a support assembly that is convenient, easy and safe to use, and provides a caregiver with greater freedom to perform other tasks while the infant is feeding. Parents of more than one young child can give the child a bottle as they feed or otherwise care for the infant's siblings. While keeping an eye on the baby, a caregiver can also straighten a room, do the dishes, or perform countless other tasks. The baby bottle support assembly is also ideal for use in a vehicle where it holds the bottle so that a caregiver can continue driving and not have to worry about a dropped bottle. The assembly can also be used by operators of day care facilities and those who provide private babysitting services from their homes.

BRIEF SUMMARY OF THE INVENTION

In view of the foregoing background, it is therefore an object of the present invention to provide a baby bottle support assembly. These and other objects, features, and advantages of the invention are provided by a baby bottle support assembly for assisting a caregiver in feeding a baby.

The assembly includes a telescopically adjustable support strap that has slidably confronting first and second sections. The width of the first section is equal to the width of the second section. The first section preferably has a length less than the length of the second section. Such a first section has opposed end portions and a groove medially formed in a top surface of the first section and extending along a partial length thereof.

The groove extends downwardly from the top surface and terminates medially between the top surface and a bottom surface of the first section. Such a groove originates medially of the first section and terminates at a position adjacent to one of the end portions of the first section. The second section has opposed end portions and a finger member monolithically formed with one of the end portions. Such a finger member is suitably sized and shaped such that the finger member can effectively be slidably engaged with the groove. The support strap has a generally concave shape. The first section and the second section are caused to overlap when the finger member slidably engages the groove such that a length of the support strap can conveniently and effectively be adjusted. The support strap includes a retaining member disposed about one end portion of the first and second sections respectively such that the finger member can be maintained in the groove.

A ring member is included that has a monolithically formed handle. Such a handle is slidably engageable with the support strap so that the handle extends about a latitudinal circumference of the strap and receives the strap therethrough. The ring member may be slidably engageable with the second section such that the position of the ring member can conveniently and effectively be adapted according to a user's needs. The support strap and the ring member are formed from suitably rigid material for effectively supporting a weight of a beverage bottle during operating conditions.

A mechanism is included for fastening the support strap to a support surface. Such a fastening mechanism further includes a plurality of pins. Each pin defines a fulcrum axis about which the first and the second sections are pivoted respectively. The fastening mechanism preferably includes a plurality of clips that have U-shaped lower portions and monolithically formed upper portions respectively. One clip is directly and pivotally connected to one end portion of the first section. Another clip is directly and pivotally connected to one end portions of the second section. The support strap is selectively adaptable between raised and lowered positions when the first and second sections are pivoted about a horizontal axis. The clips may be formed from spring steel and may be deformably resilient such that the clips can advantageously and effectively be adapted to a variety of surfaces to maintain the support strap at a substantially stable position during operating conditions. The upper portions of such clips are preferably offset from a vertical axis such that the opposed end portions of the first and the second sections can effectively be pivoted between raised and lowered positions.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
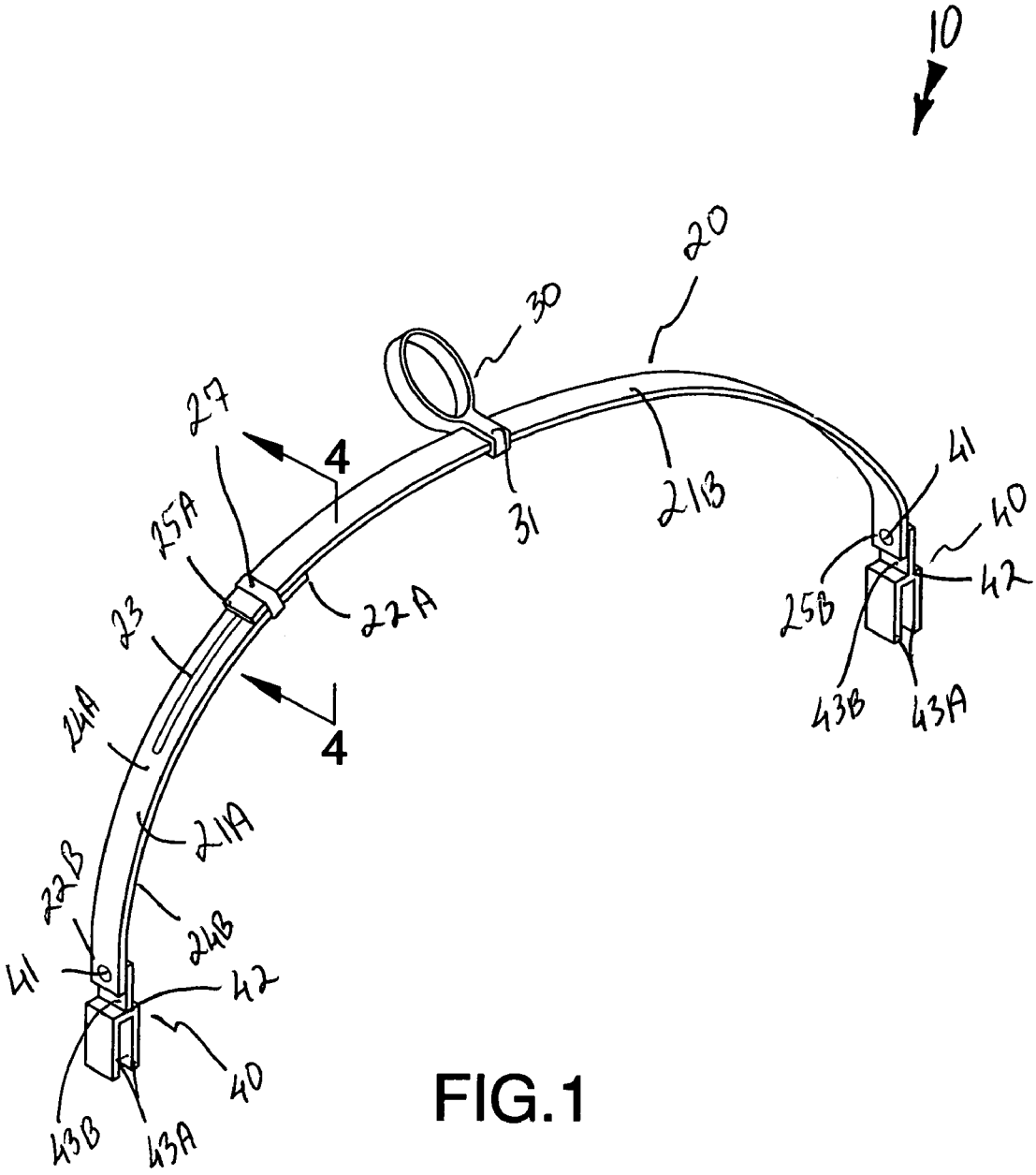
FIG. 1 is a perspective view showing a baby bottle support assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–4 by the reference numeral 10 and is intended to provide a baby bottle support assembly. It should be understood that the assembly 10 may be used to support many different types of objects and should not be limited in use to only supporting baby bottles.

Figure 2:
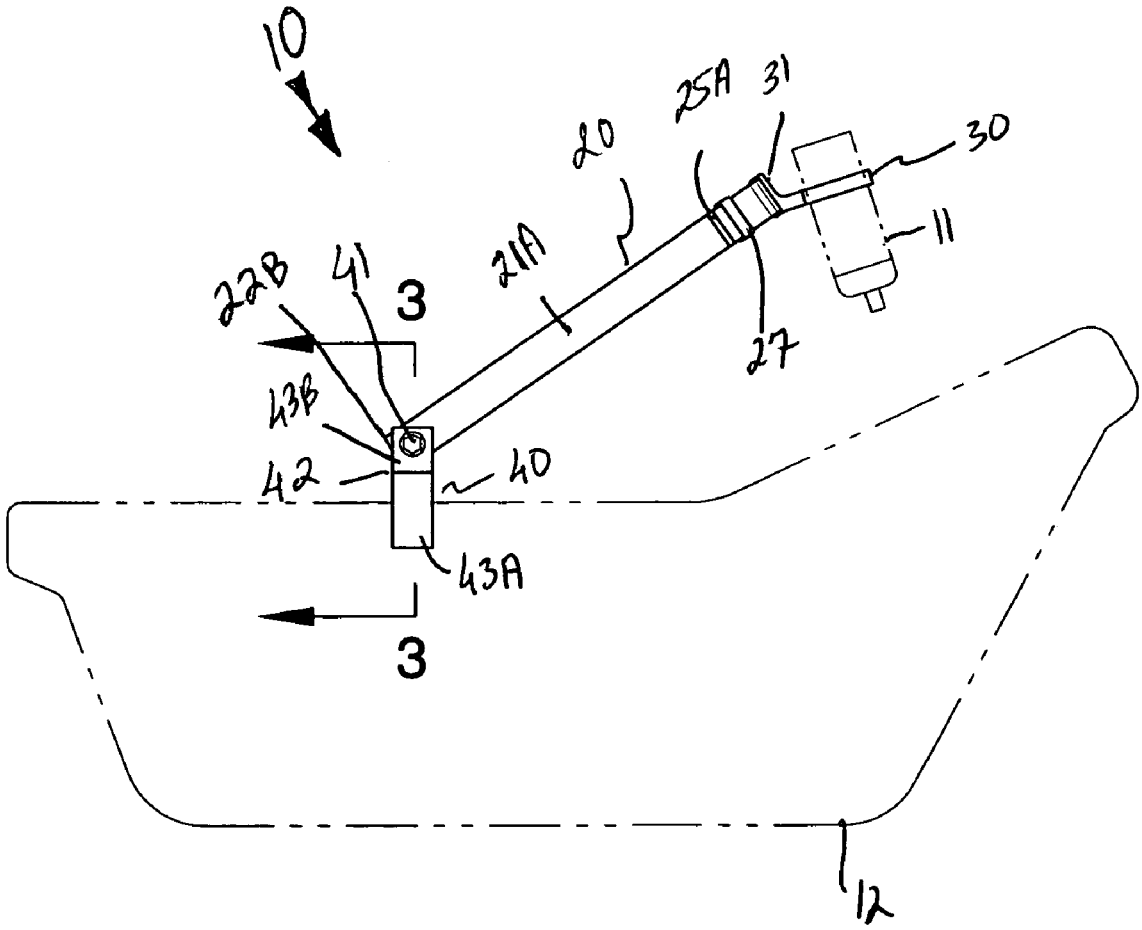
FIG. 2 is a side-elevational view of the assembly shown in FIG. 1, showing the assembly attached to a baby seat.
Figure 4:
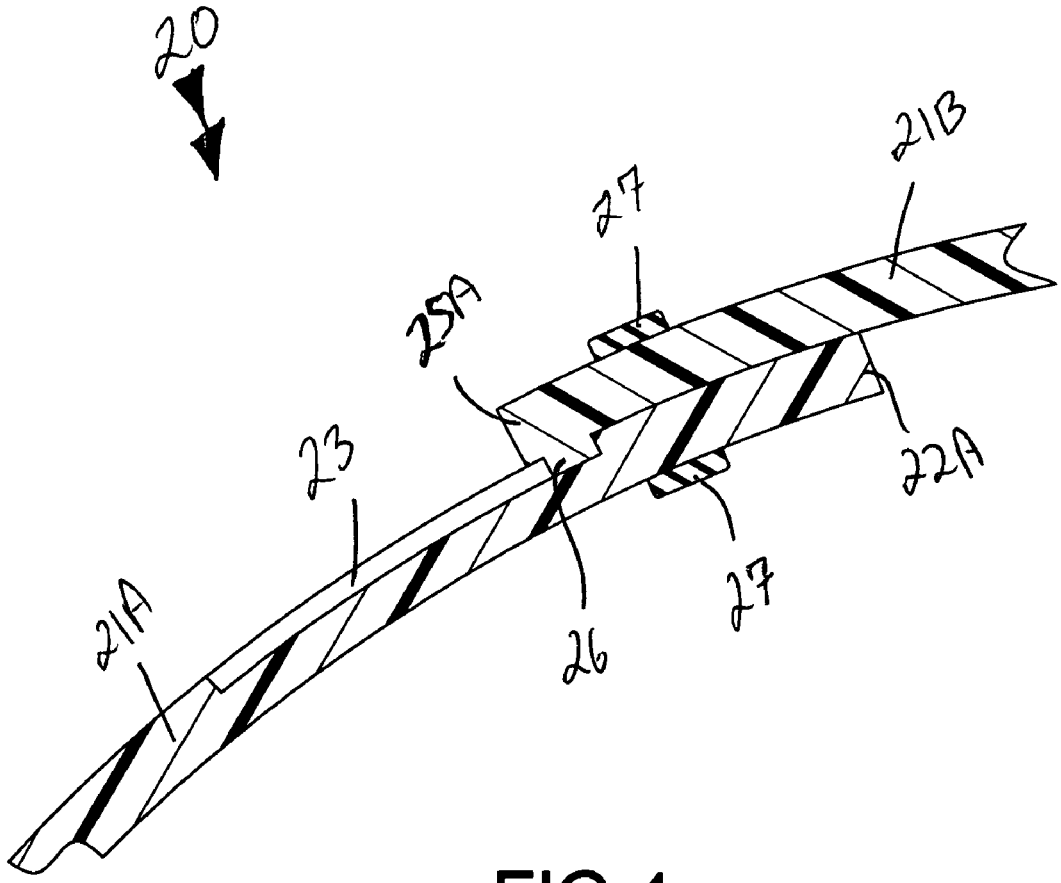
FIG. 4 is a cross-sectional view of the first and second shown in FIG. 1, taken along line 44 and shown in the finger member positioned within the groove.

Referring initially to FIGS. 1, 2 and 4, the assembly 10 includes a telescopically adjustable support strap 20 that has slidably confronting first 21A and second 21B sections. The width of the first section 21A is equal to the width of the second section 21B. Of course, the first 21A and second 21B sections may be produced in a variety of widths as well as with alternate lengths, as is obvious to a person of ordinary skill in the art. The first section 21A has a length less than the length of the second section 21B, as is best shown in FIG. 1. OF course, the first 21A and second 21B sections may be produced in a variety of different lengths and colors, as is obvious to a person of ordinary skill in the art. Such a first section 21A has opposed end portions 22 and a groove 23 medially formed in a top surface 24A of the first section 21 and extending along a partial length thereof.

Referring to FIGS. 1 and 4, the groove 23 extends downwardly from the top surface 24A and terminates medially between the top surface 24A and a bottom surface 24B of the first section 21A. Such a groove 23 originates medially of the first section 21A and terminates at a position adjacent to one 22A of the end portions 22 of the first section 21A. The second section 21B has opposed end portions 25 and a finger member 26 monolithically formed with one 25A of the end portions 25, as is best shown in FIG. 4. Such a finger member 26 is suitably sized and shaped such that the finger member 26 can effectively be slidably engaged with the groove 23, which is essential for adjusting a width of the support strap 20. The support strap 20 has a generally concave shape, as is best illustrated in FIG. 1. The first section 21A and the second section 21B are caused to overlap when the finger member 26 slidably engages the groove 23, which is crucial such that a length of the support strap 20 can conveniently and effectively be adjusted.

Referring to FIGS. 1, 2 and 4, the support strap 20 includes a retaining member 27 disposed about one end portion 22A, 25A of the first 21A and second 21B sections respectively such that the finger member 26 can effectively be maintained in the groove 23. Such a retaining member 27 is advantageous and essential for preventing a longitudinal length of the strap 20 from being altered during operating conditions, while still allowing a caretaker to selectively adjust a length of the strap 20 prior to a use thereof.

Referring to FIGS. 1 and 2, a ring member 30 is included that has a monolithically formed handle 31. Such a handle 31 is slidably engageable with the support strap 20 so that the handle 31 extends about a latitudinal circumference of the strap 20 and receives the strap 20 therethrough. The ring member 30 is slidably engageable with the second section 21B such that the position of the ring member 30 can conveniently and effectively be adapted according to a user's needs. This feature is especially important for preventing the bottle 11 from slipping out of an infant's mouth as they move their head from side to side during feeding. The support strap 20 and the ring member 30 are formed from suitably rigid material, which is crucial for effectively supporting a weight of a beverage bottle 11 during operating conditions. This feature advantageously ensures that the bottle 11 remains positioned within the ring member 30 such that a parent does not have to reposition it, which is especially convenient while driving with the infant in a car seat or walking the baby in a stroller.

Figure 3:
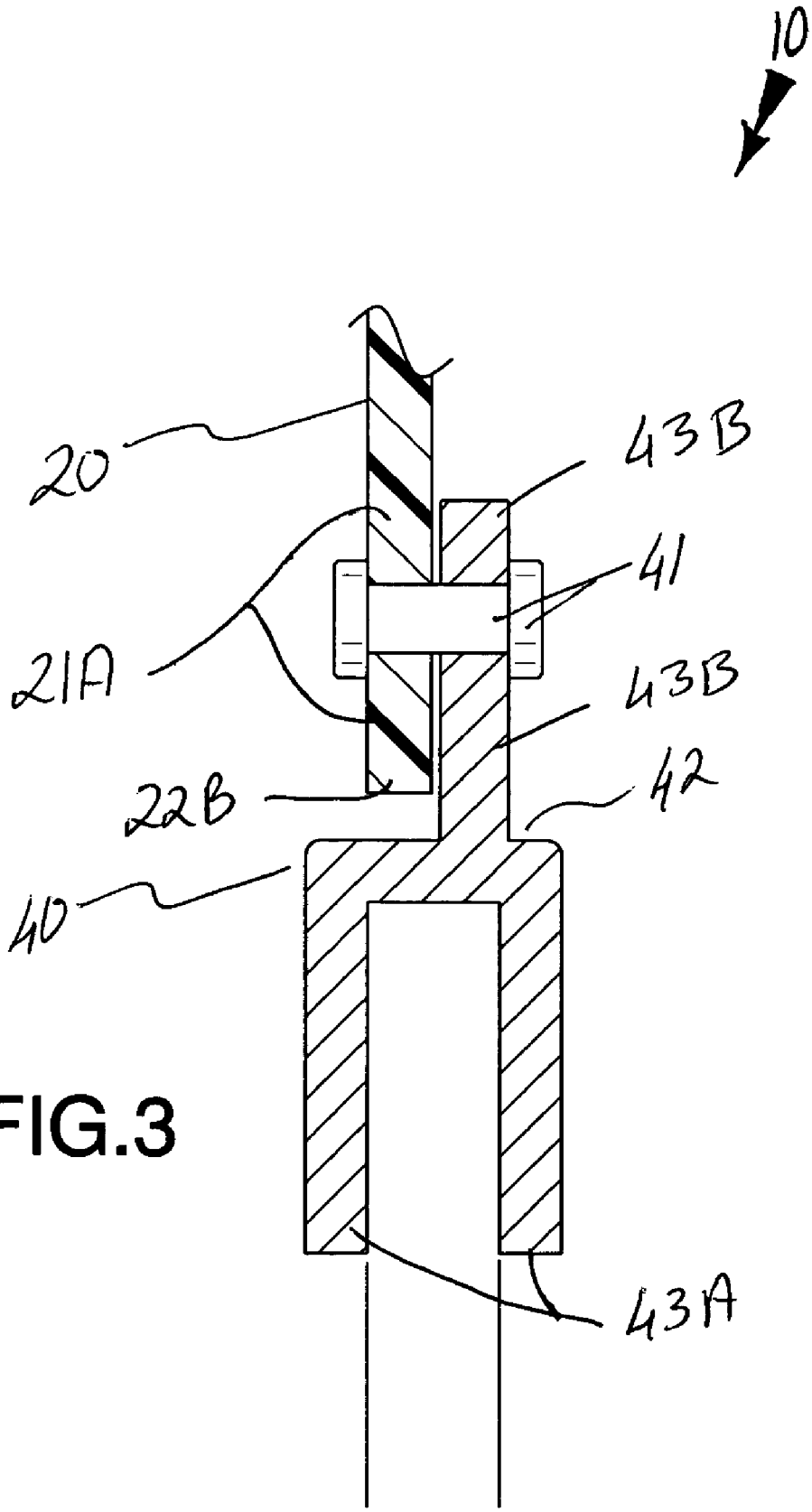
FIG. 3 is a cross-sectional view of the clip shown in FIG. 2, taken along line 3—3.

Referring to FIGS. 1 through 3, a mechanism 40 is included for fastening the support strap 20 to a support surface 12. Such a fastening mechanism 40 further includes a plurality of pins 41. Each pin 41 defines a fulcrum axis about which the first 21A and the second 21B sections are pivoted respectively. The fastening mechanism 40 includes a plurality of clips 42 that have U-shaped lower portions 43A and monolithically formed upper portions 43B respectively. One clip 42A is directly and pivotally connected, with no intervening elements, to one end portion 22B of the first section 21A. Another clip 42B is directly and pivotally connected, with no intervening elements, to one end portion 25B of the second section 21B. The support strap 20 is selectively adaptable between raised and lowered positions when the first 21A and second 21B sections are pivoted about a horizontal axis.

Still referring to FIGS. 1 through 3, the clips 42 are formed from spring steel and are deformably resilient, which is vital such that the clips 42 can advantageously and effectively be adapted to a variety of surfaces 12 to maintain the support strap 20 at a substantially stable position during operating conditions. Such spring steel clips 42 have improved grip over alternate attachment mechanism such as a spring loaded clip or a clamp that can easily be removed from the support surface 12. Conventionally, alternate clips employed in the prior art are constructed of plastic, which has a tendency to bend and break due to the stress associated with supporting a bottle 11. The spring loaded clips 42 are also less expensive to produce than other clips and thus, reduce the overall cost of the assembly 10. The upper portions 43B of such clips 42 are offset from a vertical axis such that the opposed end portions 22B, 25B of the first 21A and the second 21B sections can effectively be pivoted between raised and lowered positions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A baby bottle support assembly for assisting a caregiver in feeding a baby, said assembly comprising:

a telescopically adjustable support strap having slidably confronting first and second sections, said first section having opposed end portions and a groove medially formed in a top surface of said first section and extending along a partial length thereof, the groove originating medially of said first section and terminating at a position adjacent to one said end portions of said first section, said second section having opposed end portions and a finger member monolithically formed with one said end portions, said finger member being suitably sized and shaped such that said finger member can be slidably engaged with the groove, said support strap including a retaining member disposed about one said end portions of said first and second sections respectively such that said finger member can be maintained in the groove, said support strap having a generally concave shape;

wherein said first section and said second section are caused to overlap when said finger member slidably engages the groove such that a length of said support strap can be adjusted;

a ring member having a monolithically formed handle, said handle being slidably engageable with said support strap such that said handle extends about a latitudinal circumference of said strap and receives said strap therethrough; and means for fastening said support strap to a support surface;

wherein said support strap and said ring member are formed from suitably rigid material for supporting a weight of a beverage bottle during operating conditions.

2. The assembly of claim 1, wherein said fastening means comprises: a plurality of clips having a U-shaped lower portion and a monolithically formed upper portion respectively, one said clips being directly and pivotally connected to one said end portions of said first section, another said clips being directly and pivotally connected to one said end portions of said second section;

wherein said support strap is selectively adaptable between raised and lowered positions when said first and said second sections are pivoted about a horizontal axis.

3. The assembly of claim 2, wherein said clips are formed from spring steel and are deformably resilient such that said clips can be adapted to a variety of surfaces to maintain said support strap at a substantially stable position during operating conditions.

4. The assembly of claim 1, wherein said ring member is slidably engageable with said second section such that the position of said ring member can be adapted according to a user's needs.

5. The assembly of claim 1, wherein said upper portion of said clips is offset from a vertical axis such that said opposed end portions of said first and said second sections can be pivoted between raised and lowered positions.

6. The assembly of claim 1, wherein said first section has a length less than the length of said second section.

7. A baby bottle support assembly for assisting a caregiver in feeding a baby, said assembly comprising:

a telescopically adjustable support strap having slidably confronting first and second sections, said first section having opposed end portions and a groove medially formed in a top surface of said first section and extending along a partial length thereof, the groove originating medially of said first section and terminating at a position adjacent to one said end portions of said first section, said second section having opposed end portions and a finger member monolithically formed with one said end portions, said finger member being suitably sized and shaped such that said finger member can be slidably engaged with the groove, said support strap including a retaining member disposed about one said end portions of said first and second sections respectively such that said finger member can be maintained in the groove, said support strap having a generally concave shape;

wherein said first section and said second section are caused to overlap when said finger member slidably engages the groove such that a length of said support strap can be adjusted;

a ring member having a monolithically formed handle, said handle being slidably engageable with said support strap such that said handle extends about a latitudinal circumference of said strap and receives said strap therethrough; and means for fastening said support strap to a support surface, said fastening means further comprising: a plurality of pins, each said pin defining a fulcrum axis about which said first and said second sections are pivoted respectively;

wherein said support strap and said ring member are formed from suitably rigid material for supporting a weight of a beverage bottle during operating conditions.

8. The assembly of claim 7, wherein said fastening means comprises: a plurality of clips having a U-shaped lower portion and a monolithically formed upper portion respectively, one said clips being directly and pivotally connected to one said end portions of said first section, another said clips being directly and pivotally connected to one said end portions of said second section;

wherein said support strap is selectively adaptable between raised and lowered positions when said first and said second sections are pivoted about a horizontal axis.

9. The assembly of claim 8, wherein said clips are formed from spring steel and are deformably resilient such that said clips can be adapted to a variety of surfaces to maintain said support strap at a substantially stable position during operating conditions.

10. The assembly of claim 7, wherein said ring member is slidably engageable with said second section such that the position of said ring member can be adapted according to a user's needs.

11. The assembly of claim 7, wherein said upper portion of said clips is offset from a vertical axis such that said opposed end portions of said first and said second sections can be pivoted between raised and lowered positions.

12. The assembly of claim 7, wherein said first section has a length less than the length of said second section.

13. A baby bottle support assembly for assisting a caregiver in feeding a baby, said assembly comprising:

a telescopically adjustable support strap having slidably confronting first and second sections, wherein the width of said first section is equal to the width of said second section, said first section having opposed end portions and a groove medially formed in a top surface of said first section and extending along a partial length thereof, the groove extending downwardly from said top surface and terminating medially between said top surface and a bottom surface of said first section, the groove originating medially of said first section and terminating at a position adjacent to one said end portions of said first section, said second section having opposed end portions and a finger member monolithically formed with one said end portions, said finger member being suitably sized and shaped such that said finger member can be slidably engaged with the groove, said support strap including a retaining member disposed about one said end portions of said first and second sections respectively such that said finger member can be maintained in the groove, said support strap having a generally concave shape;

wherein said first section and said second section are caused to overlap when said finger member slidably engages the groove such that a length of said support strap can be adjusted;

a ring member having a monolithically formed handle, said handle being slidably engageable with said support strap such that said handle extends about a latitudinal circumference of said strap and receives said strap therethrough; and means for fastening said support strap to a support surface, said fastening means further comprising: a plurality of pins, each said pin defining a fulcrum axis about which said first and said second sections are pivoted respectively;

wherein said support strap and said ring member are formed from suitably rigid material for supporting a weight of a beverage bottle during operating conditions.

14. The assembly of claim 13, wherein said fastening means comprises: a plurality of clips having a U-shaped lower portion and a monolithically formed upper portion respectively, one said clips being directly and pivotally connected to one said end portions of said first section, another said clips being directly and pivotally connected to one said end portions of said second section;

wherein said support strap is selectively adaptable between raised and lowered positions when said first and said second sections are pivoted about a horizontal axis.

15. The assembly of claim 14, wherein said clips are formed from spring steel and are deformably resilient such that said clips can be adapted to a variety of surfaces to maintain said support strap at a substantially stable position during operating conditions.

16. The assembly of claim 13, wherein said ring member is slidably engageable with said second section such that the position of said ring member can be adapted according to a user's needs.

17. The assembly of claim 13, wherein said upper portion of said clips is offset from a vertical axis such that said opposed end portions of said first and said second sections can be pivoted between raised and lowered positions.

18. The assembly of claim 13, wherein said first section has a length less than the length of said second section.

* * * * *